US009423162B2

(12) United States Patent
Roll et al.

(10) Patent No.: US 9,423,162 B2
(45) Date of Patent: Aug. 23, 2016

(54) THERMOELECTRIC TEMPERATURE CONTROL UNIT

(71) Applicant: MAHLE International GmbH, Stuttgart (DE)

(72) Inventors: Peter Roll, Vaihingen (DE); Juergen Gruenwald, Ludwigsburg (DE); Holger Schroth, Maulbronn (DE); Florin Moldovan, Stuttgart (DE); Martin Steinbach, Waiblingen (DE)

(73) Assignee: MAHLE International GmbH, Stuttgart (DE)

( * ) Notice: Subject to any disclaimer, the term of this patent is extended or adjusted under 35 U.S.C. 154(b) by 147 days.

(21) Appl. No.: 14/316,075

(22) Filed: Jun. 26, 2014

(65) Prior Publication Data

US 2015/0000308 A1 Jan. 1, 2015

(30) Foreign Application Priority Data

Jun. 27, 2013 (DE) ..... 10 2013 212 524

(51) Int. Cl.
*F25B 21/02* (2006.01)

(52) U.S. Cl.
CPC ..... *F25B 21/02* (2013.01); *F25B 2321/023* (2013.01); *F25B 2321/025* (2013.01); *F25B 2321/0212* (2013.01); *F25B 2500/06* (2013.01); *F25B 2500/09* (2013.01)

(58) Field of Classification Search
CPC ..... F25B 21/02; F25B 2321/02; F25B 2321/0212; F25B 2321/023; F25B 2321/025; F25B 2500/09
USPC ..... 62/3.2–3.7
See application file for complete search history.

(56) References Cited

U.S. PATENT DOCUMENTS

| | | | | |
|---|---|---|---|---|
| 5,409,547 | A | 4/1995 | Watanabe et al. | |
| 5,987,892 | A | 11/1999 | Watanabe et al. | |
| 6,222,113 | B1 * | 4/2001 | Ghoshal | H01L 35/32 136/201 |
| 2003/0010050 | A1 | 1/2003 | Scott | |
| 2006/0201161 | A1 * | 9/2006 | Hirai | H01L 23/38 62/3.2 |
| 2011/0275165 | A1 * | 11/2011 | Suzuki | H01L 35/32 438/4 |
| 2014/0013774 | A1 * | 1/2014 | Grunwald | F25B 21/02 62/3.2 |
| 2014/0130838 | A1 * | 5/2014 | Hida | H01L 35/08 136/205 |
| 2014/0260334 | A1 * | 9/2014 | Savelli | H01L 35/06 62/3.7 |
| 2015/0000307 | A1 * | 1/2015 | Roll | F25B 21/02 62/3.2 |
| 2015/0228883 | A1 * | 8/2015 | Boukai | H01L 35/34 438/54 |
| 2015/0369522 | A1 * | 12/2015 | Grunwald | H01L 35/04 62/3.2 |

FOREIGN PATENT DOCUMENTS

| | | |
|---|---|---|
| DE | 693 18 663 T2 | 9/1998 |
| GB | 1 040 218 | 8/1966 |

* cited by examiner

*Primary Examiner* — Daniel Rohrhoff
(74) *Attorney, Agent, or Firm* — Muncy, Geissler, Olds & Lowe, P.C.

(57) ABSTRACT

A thermoelectric temperature control unit having at least one first Peltier element, which includes a first surface and a second surface, wherein the first surface is disposed adjoining or opposite the second surface, wherein the first surface of the Peltier element is connected to a first cover plate and the second surface is connected to a second cover plate, wherein heat can be supplied at least via one of the cover plates and dissipated via the other cover plate, wherein at least one of the cover plates has a variable material thickness along one or both of the extension directions thereof, whereby at least one region having a maximal material thickness and one region having a minimal material thickness are formed.

10 Claims, 2 Drawing Sheets

THERMOELECTRIC TEMPERATURE CONTROL UNIT

This nonprovisional application claims priority under 35 U.S.C. §119(a) to German Patent Application No. DE 10 2013 212 524.0, which was filed in Germany on Jun. 27, 2013, and which is herein incorporated by reference.

BACKGROUND OF THE INVENTION

1. Field of the Invention

The present invention relates to a thermoelectric temperature control unit having at least one first Peltier element, which includes a first surface and a second surface, wherein the first surface is disposed adjoining or opposite the second surface, wherein the first surface of the Peltier element is connected to a first cover plate and the second surface is connected to a second cover plate, and wherein heat can be supplied at least via one of the cover plates and dissipated via the other cover plate.

2. Description of the Background Art

Motor vehicles having additional electric drives or all-electric drives generally require electric energy stores. These energy stores are able to temporarily store electrical energy and keep it available.

Depending on the operating situation and ambient conditions, these energy stores have to be heated or cooled. This is necessary in particular to continuously maintain the energy stores in a defined temperature window in which they operate optimally. Excessively high temperatures in particular can result in damage and premature aging of the energy stores. Temperatures that are too low negatively influence performance.

In the conventional art, temperature control units are known which function utilizing the thermoelectric properties of Peltier elements. Peltier elements either generate a temperature difference on two of the boundary surfaces thereof based on an applied voltage, or they generate an electrical voltage based on a temperature difference that is present.

In any case, each of the Peltier elements has one side having a high temperature level and one side having a lower temperature level relative thereto. These different temperature levels within the thermoelectric temperature control unit result in thermal stress, which can cause damage to the thermoelectric temperature control unit.

The disadvantage of solutions from the conventional art is in particular that precautions taken are insufficient to prevent the development of thermal stress in the thermoelectric temperature control unit, or to at least reduce these enough so that no damage occurs to the thermoelectric temperature control unit, and to the Peltier elements in particular, and so that as homogeneous a temperature distribution as possible along the thermoelectric temperature control unit is achieved.

SUMMARY OF THE INVENTION

It is therefore an object of the present invention to provide a thermoelectric temperature control unit which is suited to reduce or entirely prevent the development, or negative effects, of thermal stress and/or to generate more uniform heat distribution.

An exemplary embodiment of the invention relates to a thermoelectric temperature control unit including at least one first Peltier element, which includes a first surface and a second surface, wherein the first surface is disposed adjoining or opposite the second surface, wherein the first surface of the Peltier element is connected to a first cover plate and the second surface is connected to a second cover plate, wherein heat can be supplied at least via one of the cover plates and dissipated via the other cover plate, wherein at least one of the cover plates has a variable material thickness along one or both of the extension directions thereof, whereby at least one region having a maximal material thickness and one region having a minimal material thickness are formed.

The Peltier element can be designed as a cuboid body. The first surface and the second surface are mutually opposing areas. The Peltier element can be electrically contacted so as to be able to generate heating or cooling, depending on the intended purpose.

The Peltier element can be rigidly connected to the cover plates. A flexible connecting layer may be provided between the Peltier element and the cover plates, which is used to absorb thermal stress that develops during the operation of the thermoelectric temperature control unit. However, such a flexible layer is not necessarily required.

A variable material thickness here shall mean in particular a material thickness that varies according to a predefined pattern. The pattern may be regular or irregular. A symmetrical design of the cover plate can be advantageous in such a way that regions having a maximal material thickness and regions having a minimal material thickness alternate, and the size of the cover plate can be arbitrarily scaled by attaching further regions having the maximal material thickness and regions having the minimal material thickness.

A particularly advantageous configuration of the cover plate can be achieved via a variable material thickness. In this way, in particular the temperature homogeneity across the cover plate can be improved, whereby overall the mechanical load due to thermal stress can be reduced.

The cover plate can essentially be understood to be a level planar material extension. This results in a first and a second extension direction, which extend in the plane of the cover plate. The material thickness forms the third extension direction, which is perpendicular to this plane and has a considerably smaller extension than the first and second extension directions.

Multiple Peltier elements can be disposed between the first cover plate and the second cover plate, wherein the Peltier elements are spaced apart from each other between the cover plates.

The Peltier elements can be spaced apart from each other. This is used in particular to generate a homogeneous temperature distribution across the cover plate. Multiple Peltier elements are particularly advantageous so as to be able to adapt the performance capability of the thermoelectric temperature control unit.

Moreover, at least one of the cover plates can include multiple regions having a maximal material thickness and multiple regions having a minimal material thickness, wherein the regions having the maximal material thickness are designed as plateau-shaped regions, which are spaced apart from each other by the regions having the minimal material thickness.

Such a configuration of the cover plate is particularly advantageous since, in particular with a larger extension of the cover plate in the first and second extension directions, a particularly homogeneous temperature distribution across the cover plate can be generated by providing multiple regions having the maximal material thickness and by providing multiple regions having the minimal material thickness. This is particularly the case when multiple heat input sources, such as Peltier elements, are connected to the cover plate.

The Peltier elements can be disposed on the regions of the cover plate having the maximal material thickness.

Since the heat input is the greatest in particular the regions of the contact areas between the Peltier elements and the cover plates, it is particularly advantageous to design the material thickness to be maximal there. Overheating of individual regions of the cover plate can thus be avoided.

This heat input in the region of the contact areas results in a heat distribution across the cover plate that includes regions having high heat and regions having lower heat. In the regions having lower heat, which are located in particular between the contact areas, what are known as "thermally neutral fibers" of the cover plate can be found. These neutral fibers can be located centrally between the points of the cover plate that have the highest heat input.

Moreover, web-like elements can be provided between the regions having the maximal material thickness, these elements increasing the stability of the cover plate notably in regions having the lower material thickness.

These web-like elements increase the rigidity of the cover plate, which is partially reduced by the reduction of the material thickness. In this way, overall a more stable cover plate can be generated. Providing the web-like elements so as to increase the rigidity of the cover plate is particularly advantageous since considerably less material is required than with a cover plate that is made of solid material having a uniform material thickness. This procedure for reinforcement of the cover plate aids the lightweight construction of the cover plate.

Channel-like regions can be formed through the regions having the minimal material thickness between the regions having the maximal material thickness, these channel-like regions being partially or completely interrupted by the web-like elements.

The channel-like regions are particularly advantageous since a fluid, such as air, can flow through them and thus additionally support heat transfer. The channel-like regions, which are preferably located outside the contact areas between the Peltier elements and the cover plate, form regions having a lower temperature. This is particularly advantageous for connecting elements on the opposite side of the cover plate, which are preferably disposed in regions having a lower temperature level.

According to an embodiment of the invention, it may be provided that the regions having the maximal material thickness are spaced apart from each other in one of the extension directions of the cover plate at a first distance that is greater than the second distance at which the regions having the maximal material thickness are spaced apart from each other in the other extension direction of the cover plate.

By varying the distances along the two extension directions, additionally the resulting heat distribution along the cover plate can be influenced. The heat distribution within the cover plate can be influenced in particular as a function of the arrangement of the Peltier elements on the one side of the cover plate and the arrangement of the battery elements on the other side of the cover plate.

Moreover, the transitions between a region having the maximal material thickness and an adjoining region having the minimal material thickness can extend steadily and evenly.

Steadily and evenly can mean, for example, that no sharp-edged shoulders or protrusions, which negatively influence heat distribution, are present in the transitions. Corners and edges can lead to heat build-up in the material, resulting in uneven heat distribution and the development of what are known as "hot spots."

Moreover, the Peltier elements can be connected to at least one of the cover plates by way of an adhesive, wherein thermal stress can be compensated for by the adhesive.

An adhesive for connecting the Peltier elements to at least one of the cover plates is particularly advantageous since not only a simple assembly process is ensured, but also a certain portion of stress that develops can be compensated for by the adhesive. Depending on the anticipated stress, the adhesive should be selected in such a way that sufficient consideration is given not only to the durability requirements and temperature compatibility, but also to the maximal ability to absorb mechanical stress, which can occur as a result of the thermal stress. The adhesive advantageously has high thermal conductivity. This can be promoted, for example, by introducing particles that increase the thermal conductivity.

Moreover, one of the cover plates can be in thermal contact with at least one battery element, wherein the respective other cover plate is in thermal contact with a heat exchanger, wherein an actively temperature-controllable fluid can flow through the heat exchanger.

Heat can thus be supplied to the battery elements by actively heating the fluid. The heat that is supplied to the battery elements is the sum of the heat of the actively temperature-controlled fluid and the heating output of the Peltier elements. As an alternative, the battery elements can be cooled by transferring the heat from the battery elements via the Peltier elements to the fluid, wherein the heat is transported away from the thermoelectric temperature control unit by the fluid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
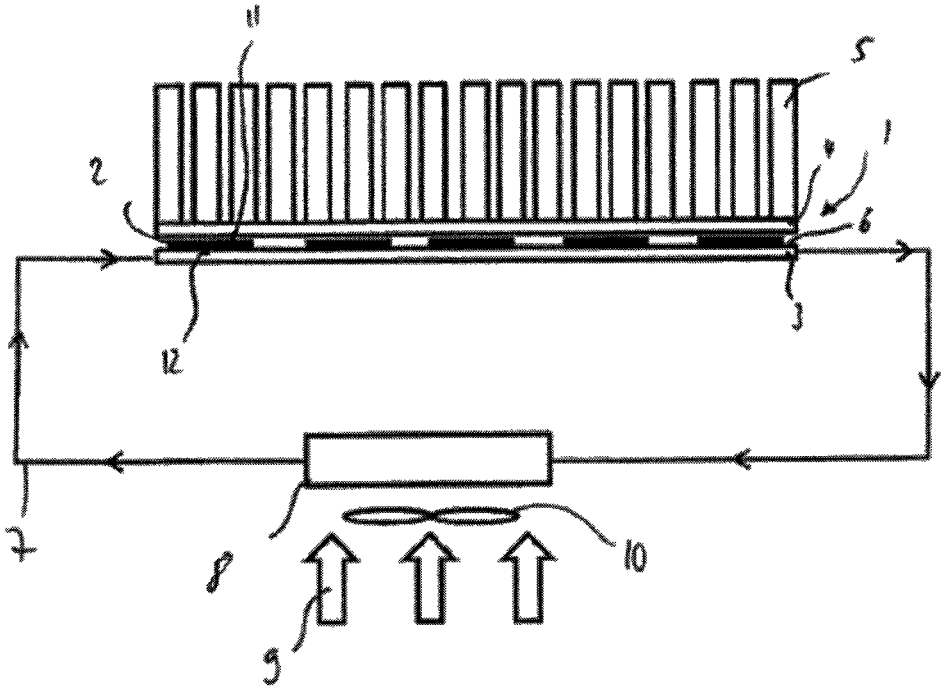
FIG. 1 shows a schematic view of a thermoelectric temperature control unit, wherein the thermoelectric temperature control unit is connected to a fluid circuit via which heat can be dissipated or supplied.

FIG. 1 shows a schematic view of a thermoelectric temperature control unit 1. FIG. 1 shows the thermoelectric temperature control unit 1 in a section, and it is not shown completely since only the principle of the thermoelectric temperature control unit 1 is to be represented.

Multiple battery elements 5 are disposed above the thermoelectric temperature control unit 1, the temperature of these battery elements being controlled by way of the thermoelectric temperature control unit 1. The thermoelectric temperature control unit 1 is essentially composed of multiple Peltier elements 2, which are able to transfer heat from one of the outer surfaces thereof to the opposing outer surface by the application of a voltage. The battery elements 5 can thus either be cooled or heated. Heat can be supplied or dissipated via the fluid circuit 7.

For this purpose, a first surface 12 of the Peltier elements 2 is in thermal contact with a flow channel of a heat exchanger 6. The heat exchanger 6 forms an interface with the fluid circuit 7 and can be formed by pipes through which fluid flows, for example. The fluid can be air or a liquid, for example. The connection of the first surfaces 12 to the heat exchanger takes place in the exemplary embodiment shown in FIG. 1 via a cover plate 3, which is disposed as an intermediate element between the flow channels of the heat exchanger 6 and the Peltier elements 2.

As an alternative, the thermally conducting connection can also be established directly with the heat exchanger by applying the Peltier elements to the flow channels of the heat exchanger without an intermediate element.

The second surface 11 of the Peltier elements 2 located opposite the first surface 12 is in thermal contact with a further cover plate 4. Multiple battery elements 5 are disposed above the cover plate 4. The heat that is emitted by the battery elements 5 is transported by the Peltier elements 2 to the contact point of the Peltier elements 2 with the fluid circuit 7 and is given off to the fluid flowing in the fluid circuit 7. During a heating mode, heat would be transported accordingly from the fluid circuit 7 to the battery elements 5.

The heat from the fluid circuit 7 can be further increased by the heating output of the Peltier elements 2.

The amount of heat that is given off to the fluid in the fluid circuit 7 is then given off to the surroundings via a heat exchanger 8, to which a fan 10 supplies a flow of air 9. The design of the fluid circuit 7 and the components contained therein outside the thermoelectric temperature control unit 1 do not form subject matter of the invention and will therefore not be described further in detail.

Figure 2:
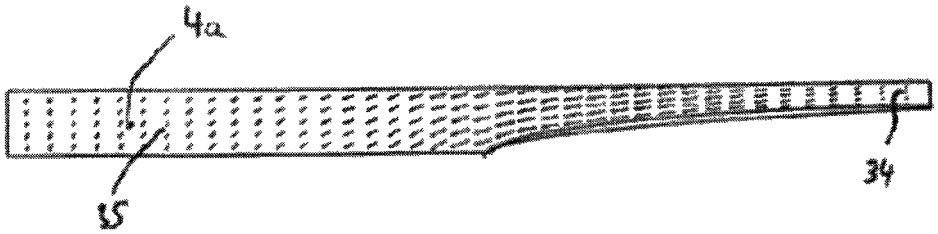
FIG. 2 shows a partial view of a cover plate having an irregular material thickness.

FIG. 2 shows a partial section of a cover plate 4*a*. It is in particular apparent in this partial section of FIG. 2 that there is a region having a maximal material thickness 35 and a region having a minimal material thickness 34. The region having the maximal material thickness 35 is in particular the region that represents the contact region with the Peltier elements. The Peltier elements are not shown in FIG. 2.

The greatest heat input takes place in the region having the maximal material thickness 35 since the Peltier elements are connected to the cover plate 4*a* in this region. In particular the thermally neutral fibers are located in the region having the minimal material thickness 34, which form a kind of zero line for the thermal stress that develops within the cover plate 4*a*. These thermally neutral fibers are typically disposed centrally between two regions having high heat input.

The transition between the region having the minimal material thickness 34 and the region having the maximal material thickness 35 is shown to be as flowing as possible and dispenses with sharp shoulders and edges. Ideally, no radii of curvature smaller than 10 mm should be provided for the configuration of the transitions. Dispensing with sharp edges, shoulders and corners is particularly advantageous with respect to the homogeneous temperature distribution across the cover plate 4*a*, which is illustrated by the shown vector field of the heat flow.

Figure 3:
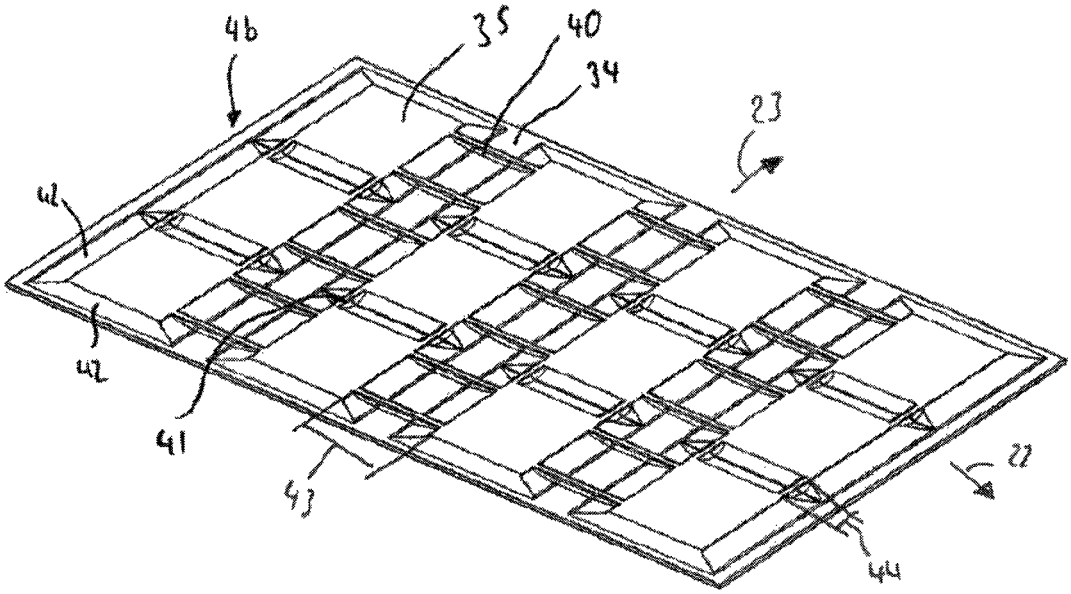
FIG. 3 shows a perspective view of a cover plate, wherein the cover plate includes regions having different material thicknesses, and web-like elements are provided between the regions having a maximal material thickness.

FIG. 3 shows a further alternative embodiment of a cover plate 4*b*. FIG. 3 shows a view onto the bottom side of the cover plate 4*b* to which the Peltier elements can be connected. In particular the regions having the maximal material thickness 35 and the regions having the minimal material thickness 34 are apparent.

In the exemplary embodiment of FIG. 3, twelve regions having the maximal material thickness 35 are disposed in a four by three grid and are used to connect a Peltier element 2. The cover plate 4*b* can be designed to go beyond the section shown in FIG. 3. The cover plate 4*b* generally has a symmetrical design and can be arbitrarily further scaled in the two extension directions 22, 23.

Transition regions 42 are disposed between the regions having the maximal material thickness 35 and the regions having the minimal material thickness 34 and, similarly to the progression shown in FIG. 2, lead from the region having the maximal material thickness 35 to the region having the minimal material thickness 34.

The regions having the minimal material thickness 34 form channel-like regions between the regions having the maximal material thickness 35. In one of the extension directions 22, the regions having the maximal material thickness 35 are spaced apart from each other at a first distance 43, and in the other extension direction 23 they are spaced apart from each other at a second distance 44. These distances 43, 44 allow the cover plate 4*b* to be adapted to the specific requirements resulting from the elements to be connected, such as the Peltier elements 2 or the battery elements 5. In particular the heat distribution along the cover plate 4*b* can be influenced by these distances 43, 44.

Multiple web-like elements 40 are disposed in one extension direction 22 of the cover plate 4*b* between the regions having the maximal material thickness 35. Web-like elements 41 are disposed between the regions having the maximal material thickness 35 in the other extension direction 23. These web-like elements 40 and 41 are used to compensate for the loss of rigidity caused by the regions having the minimal material thickness 34 in the cover plate 4*b*.

Due to the web-like elements 40 and 41, the cover plate 4*b* can achieve a similar basic rigidity as a cover plate without different material thicknesses. The web-like elements 40 and 41 can be configured across the entire height of the depressions that are formed between the regions having the maximal material thickness 35, or only across a portion of this height.

It is apparent in particular in the regions that are bridged by the web-like elements 41 that the transitions from the regions having the maximal material thickness 35 to the regions having the minimal material thickness 34 extend without sharp edges. As was already indicated in FIG. 2, all the transitions are rounded and have no radii of curvature smaller than 10 mm.

The regions having the maximal material thickness 35 are designed as plateau-like regions. The upwardly directed surface of the plateau-like regions is square. This surface is advantageously adapted to the shape of the Peltier elements that are used.

Figure 4:
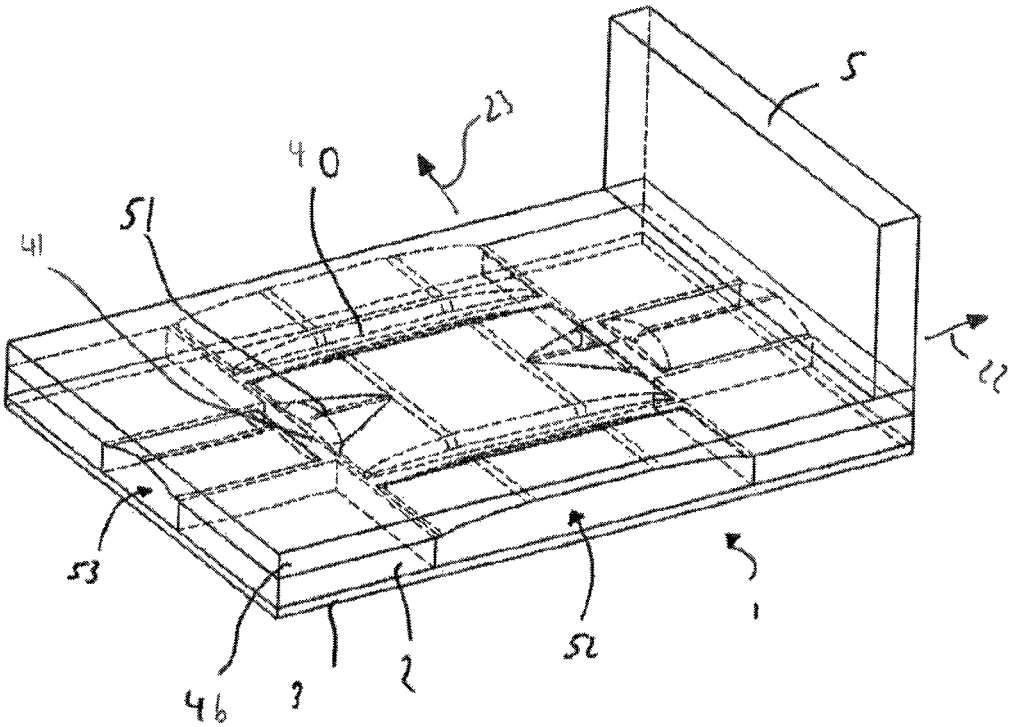
FIG. 4 shows a perspective view of a thermoelectric temperature control unit, wherein a cover plate having an irregular material thickness is used.

FIG. 4 shows a further alternative exemplary embodiment of a thermoelectric temperature control unit 1. The thermoelectric temperature control unit 1 of FIG. 4 comprises the cover plate 4*b*, which was already described in FIG. 3.

The cover plate 4*b* is designed in such a way that the channels 52 and 53 extending between the Peltier elements 2 have an outline that is linear downward toward the cover plate 3 and curved upward toward the cover plate 4*b*. These channels 52, 53, which extend along the extension directions 22, 23, are formed by the regions having the minimal material thickness 34.

Web-like elements 40 are disposed along the channel 52. Web-like elements 41 are disposed in the channel 53. As was already described in FIG. 3, these are used to increase the rigidity of the cover plate 4*b*.

Funnel-shaped transitions 51, which result from the radii of curvature of the channels 52 and 53, are provided along the narrower channel 53, in particular at the intersecting point with the channel 52.

A battery element 5 is indicated on the top side of the cover plate 4*b*. In an alternative embodiment, it is also possible for multiple battery elements to be provided on the cover plate.

One configuration of the cover plate 4*b* allows in particular a cover plate to be achieved which has high temperature homogeneity. The temperature distribution can be influenced by the different material thicknesses. The different material thicknesses moreover already offer an improved option for absorbing thermal stress since the different material thicknesses are also accompanied by different strength of the individual regions.

The individual features of the exemplary embodiments of FIGS. 1 to 4 can be combined with each other. The shown exemplary embodiments do not have a limiting nature. This applies in particular with respect to the parameters, such as the geometric design, the size and the material selection, as well as the number of Peltier elements in extension direction 22 and/or in extension direction 23. FIGS. 1 to 4 are shown by way of example and serve to illustrate the inventive idea. They have no limiting effect.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A thermoelectric temperature control unit comprising:

at least one first Peltier element that has a first surface and a second surface, the first surface being disposed adjoining or opposite the second surface, the first surface of the first Peltier element being connected to a first cover plate and the second surface being connected to a second cover plate, heat being suppliable at least via the first or second cover plates and dissipatable via the other cover plate, wherein at least one of the first or second cover plates has a variable material thickness along one or both of the extension directions thereof, and at least one region having a maximal material thickness and one region having a minimal material thickness are formed, and wherein web elements are provided between the regions having the maximal material thickness, the web elements increasing the stability of the cover plate in the regions having the lower material thickness.

2. The thermoelectric temperature control unit according to claim 1, wherein multiple Peltier elements are arranged between the first cover plate and the second cover plate, the Peltier elements being spaced apart from each other between the cover plates.

3. The thermoelectric temperature control unit according to claim 1, wherein at least one of the first or second cover plates includes multiple regions having the maximal material thickness and multiple regions having the minimal material thickness, the regions having the maximal material thickness being designed as plateau-shaped regions, which are spaced apart from each other by the regions having the minimal material thickness.

4. A thermoelectric temperature control unit according to claim 1, wherein the Peltier elements are disposed on the regions having the maximal material thickness of the cover plate.

5. The thermoelectric temperature control unit according to claim 1, wherein channel regions are formed through the regions having the minimal material thickness between the regions having the maximal material thickness, the channel regions being partially or completely interrupted by the web like web elements.

6. The thermoelectric temperature control unit according to claim 5, wherein the channel regions are hollow.

7. The thermoelectric temperature control unit according to claim 1, wherein the transitions between a region having the maximal material thickness and an adjoining region having the minimal material thickness extend steadily and evenly.

8. The thermoelectric temperature control unit according to claim 1, wherein the Peltier elements are connected to at least one of the first or second cover plates by an adhesive, the adhesive being able to compensate for thermal stress.

9. The thermoelectric temperature control unit according to claim 1, wherein one of the first or second cover plates is in thermal contact with at least one battery element, the respective other cover plate being in thermal contact with a heat exchanger, and wherein an actively temperature-controllable fluid flows through the heat exchanger.

10. A thermoelectric temperature control unit comprising:

at least one first Peltier element that has a first surface and a second surface, the first surface being disposed adjoining or opposite the second surface, the first surface of the first Peltier element being connected to a first cover plate and the second surface being connected to a second cover plate, heat being suppliable at least via the first or second cover plates and dissipatable via the other cover plate, wherein at least one of the first or second cover plates has a variable material thickness along one or both of the extension directions thereof, and at least one region having a maximal material thickness and at least one region having a minimal material thickness are formed, and wherein the regions having the maximal material thickness are spaced apart from each other in one of the extension directions of the cover plate at a first distance that is greater than the second distance at which the regions having the maximal material thickness are spaced apart from each other in the other extension direction of the cover plate.

* * * * *